US012048371B2

(12) United States Patent
Kirikian et al.

(10) Patent No.: US 12,048,371 B2
(45) Date of Patent: Jul. 30, 2024

(54) BOTTLE BRUSH

(71) Applicant: Christian Kirikian, Lawrenceville, NJ (US)

(72) Inventors: Christian Kirikian, Lawrenceville, NJ (US); James Stallman, Barrington, RI (US); Dominic Luoni, Ashland, MA (US)

(73) Assignee: Christian Kirikian, Lawrenceville, NJ (US)

( * ) Notice: Subject to any disclaimer, the term of this patent is extended or adjusted under 35 U.S.C. 154(b) by 483 days.

(21) Appl. No.: 17/378,944

(22) Filed: Jul. 19, 2021

(65) Prior Publication Data

US 2022/0031055 A1 Feb. 3, 2022

Related U.S. Application Data

(63) Continuation of application No. 29/744,809, filed on Jul. 31, 2020, now Pat. No. Des. 959,850.

(51) Int. Cl.
*A46B 9/00* (2006.01)
*A46B 3/00* (2006.01)
(Continued)

(52) U.S. Cl.
CPC ..... *A46B 9/005* (2013.01); *A46B 3/00* (2013.01); *A46B 5/026* (2013.01);
(Continued)

(58) Field of Classification Search
CPC ..... A46B 9/005; A46B 3/00; A46B 5/026; A46B 15/0095; A46B 2200/3006;
(Continued)

(56) References Cited

U.S. PATENT DOCUMENTS 412,125 A * 10/1889 Scheipers ..... F41A 29/02 15/104.095
1,382,587 A * 6/1921 Withycombe ..... A46B 9/005 15/210.1

(Continued)

FOREIGN PATENT DOCUMENTS

JP 2001178797 A * 7/2001
KR 20160052669 A * 5/2016

OTHER PUBLICATIONS

Yoshitaka, Katsukawa; JP 2001178797 A; translation (Year: 2001).*
Favagrossa, Leonardo; KR 20160052669 A; translation (Year: 2016).*

*Primary Examiner* — Brian D Keller
*Assistant Examiner* — Sarah L Bundy
(74) *Attorney, Agent, or Firm* — Amster, Rothstein & Ebenstein LLP

(57) ABSTRACT

A brush for cleaning the interior of a bottle or container is provided. The brush includes at least one cleaning element installed on the distal end of a shaft. The proximal end of the shaft is shaped to be gripped by a hand of a user. The distal end of the shaft includes at least one notch formed therein, where the notch has a proximal side wall, a distal side wall oppositely disposed from the proximal side wall, and a middle section disposed between the proximal side wall and the distal side wall. Each cleaning element is installed in a corresponding notch.

18 Claims, 2 Drawing Sheets

(51) Int. Cl.
*A46B 5/02* (2006.01)
*A46B 15/00* (2006.01)
*A46D 1/00* (2006.01)

(52) U.S. Cl.
CPC ..... *A46B 15/0095* (2013.01); *A46D 1/0207* (2013.01); *A46D 1/0238* (2013.01); *A46B 2200/3006* (2013.01)

(58) Field of Classification Search
CPC ..... A46D 1/0207; A46D 1/0238; A47L 13/16; A47L 13/44
USPC ..... 15/164, 211, 244.1
See application file for complete search history.

(56) References Cited

U.S. PATENT DOCUMENTS

| | | | | |
|---|---|---|---|---|
| 2,667,655 | A * | 2/1954 | Halford, Jr. | A46B 11/00 15/210.1 |
| 3,231,921 | A * | 2/1966 | Cuervo | A47L 17/00 15/244.1 |
| 3,319,281 | A * | 5/1967 | Montgomery | A47K 11/10 15/244.1 |
| 2009/0025168 | A1* | 1/2009 | DeRoma | B25G 3/38 15/220.1 |
| 2013/0139850 | A1* | 6/2013 | Axelsson | A46B 3/00 15/207.2 |
| 2014/0143968 | A1* | 5/2014 | De Ricco | A46B 9/025 15/167.1 |
| 2021/0386188 | A1* | 12/2021 | Gillespie | A46B 5/0095 |

* cited by examiner

BOTTLE BRUSH

CROSS REFERENCE TO RELATED APPLICATIONS

This application is a continuation of, and claims the benefit of and priority to, U.S. patent application Ser. No. 29/744,809, filed Jul. 31, 2020, and entitled BRUSH BODY, the contents of which are incorporated herein by reference in their entirety as if fully set forth herein.

FIELD

The present invention generally relates to manually operated brushes, in particular, brushes for cleaning the interior surfaces of bottles or similar containers.

BACKGROUND

Brushes for cleaning the interior surfaces of a bottle or container generally include a handle that can be gripped, a head disposed on the end of the handle, and a plurality of bristles extending from the brush head. During use, the bristles make contact with and abrade the inner surfaces of a bottle to remove dirt, food, and other material. Cleaning the inner surface of a bottle generally requires inserting the head and bristles into the bottle.

A bottle must be properly and thoroughly cleaned between uses to ensure the health and safety of users of the bottle. Absent proper cleaning, a bottle may harbor bacteria and similar harmful organisms that, if ingested or exposed to, may cause illness, infection, and similar harm.

The bristles of conventional bottle brushes are often abrasive and can damage the interior surface of the bottle, thereby potentially causing leakage or the introduction of foreign matter into the bottle. In addition, the bristles of conventional bottle brushes are usually inflexible. That is, as the brush is inserted into a bottle, the bristles remain relatively rigid. This tends to minimize the surface area that the bristles come into contact with, which makes the task of cleaning the bottle interior more time consuming.

To overcome the technical issues associated with conventional bottle brushes, what is needed is a brush that can accommodate cleaning elements that do not damage a bottle's interior surface upon contact, while also maximizing the surface area that the cleaning elements come in to contact with, in order to allow for efficient cleaning.

SUMMARY

The present invention addresses the above-identified problems of conventional brushes by providing a new and improved brush capable of efficiently cleaning the interior surface of a bottle or similar enclosed container.

In accordance with exemplary embodiments, a brush comprises an elongated shaft having a proximal end and a distal end oppositely disposed from the proximal end and at least one cleaning element. In exemplary embodiments, the proximal end of the brush is shaped to be gripped by a hand of a user. In exemplary embodiments, the distal end has a first diameter and includes at least one notch formed therein. In exemplary embodiments, the at least one notch comprises a proximal side wall, a distal side wall oppositely disposed from the proximal side wall, and a middle section disposed between the proximal side wall and the distal side wall. In exemplary embodiments, each middle section of the at least one notch has a corresponding diameter that is less than the first diameter of the distal end. In exemplary embodiments, each cleaning element has a center in which an opening is formed and is disposed in a corresponding notch, whereby the middle section of the corresponding notch engages the opening of the corresponding cleaning element.

In accordance with exemplary embodiments, the cleaning element is formed of a floret of closed cell foam.

In accordance with exemplary embodiments, the proximal side wall of the notch is beveled in the direction of the proximal first end of the brush.

In accordance with exemplary embodiments, the brush further comprises a tip fastened to the distal end of the brush.

In accordance with exemplary embodiments, the tip is removably fastened to the distal end of the brush.

DESCRIPTION OF THE DRAWINGS

Exemplary embodiments of the present invention will be described with references to the accompanying figures, wherein.

DETAILED DESCRIPTION

The present invention generally relates to brushes that are adapted to clean the interior surfaces of a bottle or similar container. In embodiments, the present invention seeks to address the problems of conventional bottle and container brushes, which are not configured to efficiently clean the interior surfaces of a bottle.

Figure 1:
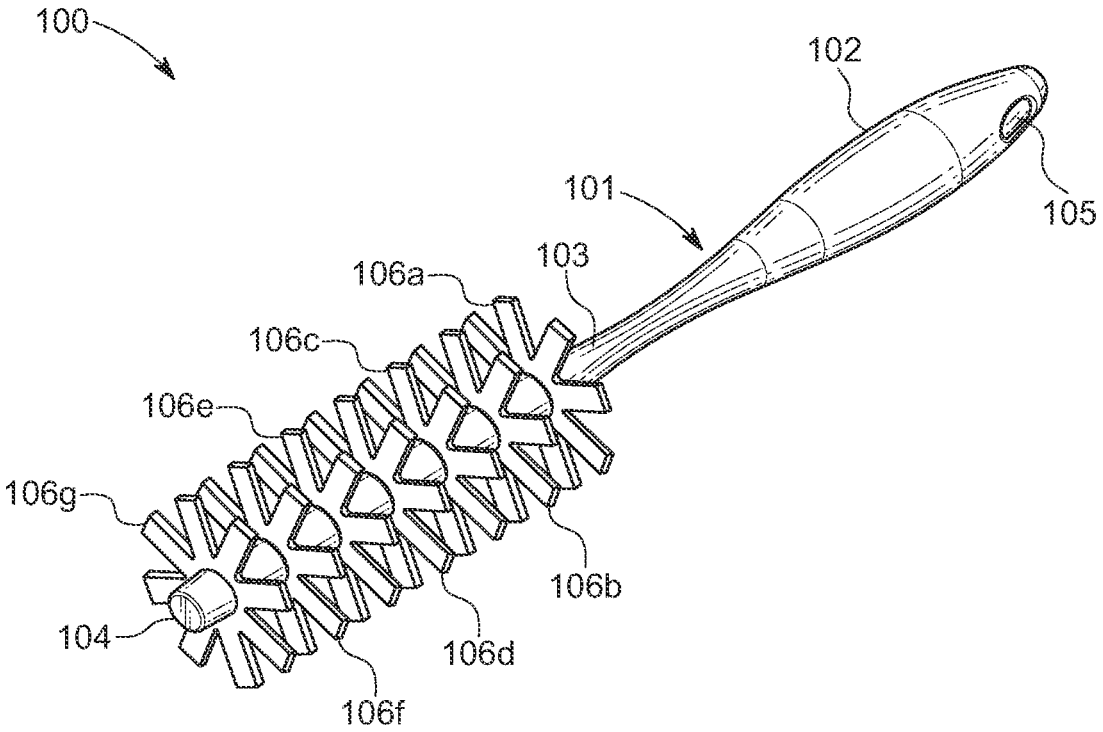
FIG. 1 illustrates a brush in accordance with exemplary embodiments of the present invention.

FIG. 1 is a perspective view of a brush 100, in accordance with exemplary embodiments of the present invention. Embodiments of brush 100 are configured to be gripped by a user at a proximal end of a handle and inserted into the opening of a bottle or container in order to clean the interior surfaces thereof. Once brush 100 is inserted into a bottle, cleaning is performed by a user by manipulating the brush via gripping the handle of moving the brush around the interior of the bottle, both radially and longitudinally.

In the embodiment shown in FIG. 1, brush 100 includes an elongated shaft or handle 101. In embodiments, handle 101 can be made of a dishwasher safe material. For example, handle 101 can be comprised of high-density polyethylene (HDPE), nylon, or polypropylene, to name a few. In embodiments, handle 101 contains no bisphenol A (i.e., is BPA-free).

As shown in FIG. 1, handle 101 has two ends, namely, a proximal end 102 and a distal end 103. In embodiments, proximal end 102 can be of greater length than distal end 103. In other embodiments, distal end 103 can be of greater length than proximal end 102. In still other embodiments, proximal end 102 and distal end 103 can be of equal length. According to embodiments, handle 101 can be 14 inches long or longer, such that brush 101 can reach the bottom surface of any size bottle and to clean the interior of any size bottle.

In embodiments, handle 101 has a circular cross section (i.e., is cylindrical in shape). In such embodiments, handle 101 can be of a uniform radius, or, as shown in FIG. 1, handle 101 can vary radially along its length. According to embodiments, handle 101 can have a radius that is 0.38 inches or smaller at the extreme distal end of distal end 103. Distal end 103 is shaped and sized to allow handle 101 to be inserted into a bottle or container in order to clean the interior surfaces thereof. Further, to ensure that handle 101 can be comfortably gripped by a user, proximal end 102 varies in radius, up to, for example, 1.131 inches at the point where a user grips proximal end 102.

As shown in FIG. 1, proximal end 102 has a rounded or convex surface which is shaped to be gripped by a hand of a user of brush 100. In embodiments, the surface of proximal end 102 is oval in shape, as shown in FIG. 1. In other embodiments, proximal end 102 can be circular or otherwise shaped to accommodate the grip of a user. In addition, proximal end 102 can be either smooth (as illustrated in FIG. 1) or textured, so as to improve the grip of a user on brush 100. In embodiments, at least a partial surface area of proximal end 102 comprises a slip-resistant material, which further improves the grip of a user on handle 101. For example, at least a part of proximal end 102 can be made of (or coated with) silicone or TPD. Alternatively, the entire surface area of proximal end 102 can be coated with, or comprised of, a slip-resistant material.

In embodiments, proximal end 102 also includes hanging hole 105, which enables brush 100 to be conveniently stored away when not in use.

Brush 100 of FIG. 1 also includes a tip 104. Tip 104 is affixed to the extreme distal end of handle 101 (i.e., at the end of distal end 103). According to embodiments, tip 104 is shaped to clean the bottom surface of a bottle into which brush 100 is inserted. As shown, tip 104 is circular in shape. In embodiments, tip 104 is cylindrical with an opening at one end, or at each end. Tip 104, in embodiments, is made of a foam material that is resistant to absorption of liquids. The foam material is also flexible and resilient so as to maximize contact with the bottom surface of a bottle.

As shown in FIG. 1, tip 104 is affixed to distal end 103 at its extreme distal point. According to embodiments, tip 104 is held in place while attached to distal end 103 by friction or a mechanical arrangement such as a bayonet joint or other similar means (not shown), which allows tip 104 to affixed to distal end 103 without glue or other adhesive. Tip 104 is of a size and shape that allows it to be inserted into the opening of a bottle or other container. In embodiments, if the size of tip 104 at rest is larger than the opening of a bottle, the foam material of which tip 104 is comprised of flexes and deforms when it comes into contact with the bottle opening. Thus, a user can push brush 100 through a narrow bottle neck, where tip 104 deforms within the bottle neck and restores to its normal size once it has been pushed all the way through the bottle neck.

Once inside a bottle or container, as a user moves brush 100 downward inside the bottle, tip 104 comes into contact with the bottom surface of the bottle. Once contact with the bottle bottom is made, a user may manipulate brush 100 (by, for example, a rotational or orbital motion) in order to effectuate pinpoint cleaning of the bottom surface.

As shown in FIG. 1, distal end 103 has disposed around its circumference cleaning elements 106. In the embodiment shown in the figure, brush 100 includes seven cleaning elements 106, labeled cleaning element 106*a*-106*g*, where 106*a* is closest to proximal end 102 and 106*g* is disposed furthest from proximal end 102, and abutting tip 104 at the extreme distal end of brush 100. Cleaning elements 106 are disposed within notches that are formed within distal end 103 (not shown in FIG. 1).

According to exemplary embodiments, each of cleaning elements 106 is comprised of a high-density foam material. The high-density foam material does not tear, rip, scratch, or otherwise damage surfaces to which they are applied. In some cases, the high-density foam material resembles foam for cleaning elements on brushes that are used in car washes. In embodiments, cleaning elements 106 are comprised of a closed cell foam, which do not absorb liquids. The closed cell foam material is flexible and resilient. That is, when the foam cleaning element comes into contact with a surface to be cleaned, the material deforms, thus increasing its area of contact with the surface. Further, when the foam cleaning element is removed from the surface, the cleaning element returns to its previous shape. Cleaning elements 106 are also dishwasher safe, meaning that they do not damage a dishwasher in which brush 100 is being cleaned. Likewise, the operation of the dishwasher does not exact any damage on cleaning elements 106. The closed cell foam inhibits water absorption and resists grit and dirt from becoming imbedded into the material.

According to embodiments, the closed cell foam may comprise any of the following materials: ethylene vinyl acetate (EVA) polymers, polyvinyl chloride polymers, and polyethylene. In other exemplary embodiments, cleaning elements 106 are comprised of crosslinked polyolefins that are either open or closed cell, and which may contain polyethylene, polypropylene and/or EVA varying in density from 1.5 to 20 pounds per cubic foot. In other exemplary embodiments, cleaning elements 106 are comprised of polyurethane with open or closed cells varying in density from 1.2 to 20 pounds per cubic foot.

As shown in FIG. 1, cleaning elements 106 each have a hole in its middle. Each cleaning element is configured to be installed on to proximal end 103 by inserting proximal end 103 into the hole and then pushing cleaning element 106 longitudinally along the length of proximal end 103 until cleaning element 106 is installed into one of the notches formed in proximal end 103. Installation of cleaning elements 106 requires removal of tip 104 from proximal end 103.

In embodiments, cleaning elements 106 are shaped to engage and clean the side surfaces of a bottle or container into which brush 100 is inserted. In embodiments, such as that shown in FIG. 1, cleaning elements 106 are circular in shape with a plurality of appendages (or "fingers") extending from the center hole. The fingers are sized so that they engage the side surfaces of a bottle or container with little effort from a user. To accomplish this, in embodiments, the fingers are of a radial size that is larger than the radius of a standard bottle or container. In this way, when brush 100 is inserted into a bottle, the fingers of cleaning elements 106 deform and engage the side surfaces of the bottle as brush 100 is pushed into the bottle interior. In this way, the side surfaces of the bottle are cleaned. Further, for bottles with large diameters, brush 100 can be manipulated by a user (via a rotating or an orbital motion, for example) so that the fingers of cleaning elements 106 engage a portion of the side surfaces that the user wishes to clean.

Additional attributes of cleaning elements 106 are described further below in connection with FIG. 4.

Figure 2:
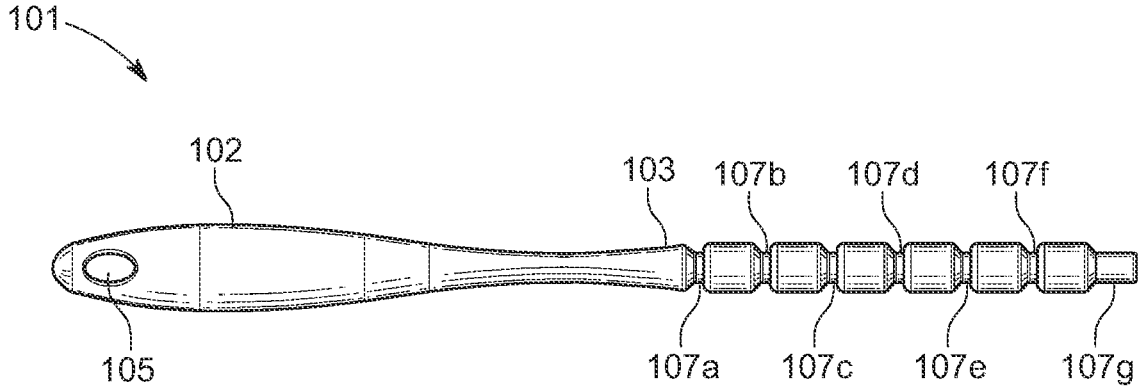
FIG. 2 illustrates a brush handle and grip in accordance with embodiments of the present invention.

FIG. 2 is a plan view of a brush handle 101 in accordance with exemplary embodiments of the present invention. As shown, handle 101 in FIG. 2 is substantially identical to handle 101 depicted in FIG. 1. Handle 101 in FIG. 2 does not have any cleaning elements attached thereto, nor does it have a tip affixed to its distal end.

Like handle 101 in FIG. 1, handle 101 in FIG. 2 includes proximal end 102 and distal end 103. As shown, proximal end 102 is shaped to be gripped by a hand of a user of brush 100. In the embodiments shown in FIG. 2, proximal end 102 has an oval shape. It should be noted that other shapes that optimize gripping by a user are possible and within the scope of the present disclosure. Further, proximal end 102 has formed therein a hanging hole 105, which allows brush 100 to be stored by inserting a hook, nail, or similar protrusion through hanging hole 105.

As shown in FIG. 2, distal end 103 has formed therein a plurality of notches 107. In the embodiment shown in the figure, distal end 103 has seven (7) notches, denoted as notches 107*a*-107*g*. In embodiments, distal end 103 can include fewer or more notches than the seven depicted in FIG. 2.

As described above in connection with FIG. 1, each notch 107 is shaped to accommodate a cleaning element, whereby the cleaning element is installed into a notch by inserting distal end 103 through the cleaning element's hole and is moving the cleaning elements longitudinally along the length of distal end 103 until the cleaning element (such as any of cleaning elements 106*a*-106*g* in FIG. 1) is installed in a desired notch 107. As shown in FIG. 2, each of the notches 107 has a proximal side wall (i.e., a side wall that is closer to proximal end 102). Further, each of notches 107, save for the rightmost (or extreme distal notch 107) has a distal side wall (i.e., a side wall that is closer to the extreme distal end of handle 101). Thus, in FIG. 2, notches 107*a*-107*f* each has both a proximal side wall and a distal side wall, while notch 107*g* only has a proximal side wall.

Further, each of notches 107*a*-107*f* has a middle section disposed between the proximal and distal side walls. As shown, the middle section of each notch 107 has a diameter that is smaller than the diameter of distal end 103. This allows a cleaning element to rest securely within any of notches 107*a*-107*f*. In embodiments, a cleaning element (such as cleaning elements 106 depicted in FIG. 1) that is installed into one of notches 107*a*-107*f* is disposed around the corresponding middle section of the notch.

In embodiments, since notch 107*g* does not have a distal side wall, the middle section of notch 107*g* (around which a cleaning element is disposed) is bounded on its distal side by a tip, such as tip 104 in FIG. 1 (not illustrated in FIG. 2). Thus, a cleaning element installed at notch 107*g* is held in place around the middle section by the distal wall and the tip that is affixed to the distal end of handle 101.

It should be noted that, since embodiments of cleaning elements 106 are comprised of a flexible and resilient foam material, each cleaning element may be moved into a first notch (such as notch 107*g*), then out of the first notch and into a second notch (such as 107*f*) and so on, until the cleaning element being installed is finally installed in a desired notch 107.

Thus, for example, to install seven cleaning elements 106 on to distal end 103 in FIG. 2, a first cleaning element 106 is inserted onto distal end 103 at notch 107*g*, and then moved progressively along distal end 103 over notches 107*f*, 107*e*, 107*d*, 107*c*, 107*b*, and finally into notch 107*a*. Continuing the example, a second notch is inserted onto distal end notch 107*g* and progressively moved along distal end 103 over notches 107-107*c* and finally into notch 107*b*. This installation pattern continues until the seventh cleaning element 107, which is simply inserted on to distal end 103 at notch 107*g*.

As shown in the figure notch 107*g* differs from the other notches 107 in that notch 107*g* only has a proximal wall, while the other notches (notches 107*a*-107*f*) have both a proximal and distal wall. Thus, in order to install a cleaning element into notch 107*g*, a user inserts distal end 103 into the hole of a cleaning element and then affixes a tip, such as tip 104, on to the extreme distal end of handle 101. The cleaning element is then bounded between the proximal side wall of notch 107*g* and the tip.

Figure 3:
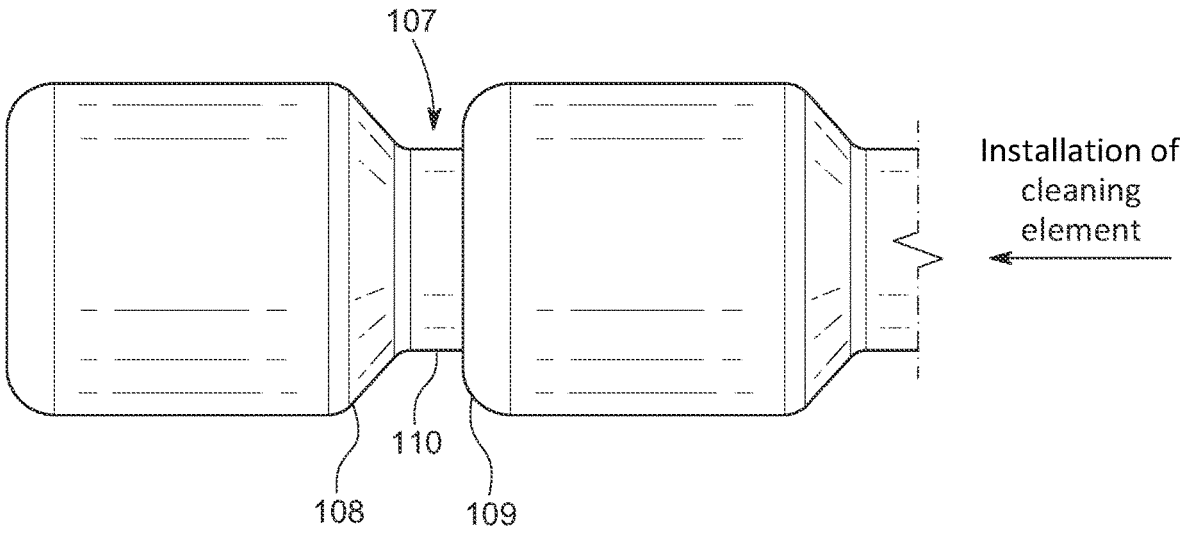
FIG. 3 illustrates a detailed view of a notch formed in a brush handle in accordance with exemplary embodiments of the present invention.

FIG. 3 is a detailed view of a notch 107 formed in a brush handle 101 in accordance with exemplary embodiments of the present invention. In FIG. 3, notch 107 includes proximal side wall 108, distal side wall 109, and middle section 110. Thus, notch 107 in the figure is of the same type as notches 107*a*-107*f* in FIG. 2, that is, a notch that has both a proximal and distal side wall.

In embodiments, as described above, a cleaning element, such as cleaning element 106, is installed into notch 107 by inserting the distal end of handle 101 into the hole of the cleaning element and then moving the cleaning element from the distal end of handle 101 until the cleaning element is seated around middle section 110. Thus, the cleaning element is installed into notch 107 from the right side of FIG. 3.

As shown in FIG. 3, proximal side wall 108 is beveled toward the proximal end of handle 101 (i.e., proximal end 102, as depicted in FIGS. 1 and 2). According to exemplary embodiments, proximal side wall is beveled to form approximately a 45-degree angle between the side wall and a line in the longitudinal direction of handle 101. As shown in FIG. 3, the beveling of proximal side wall 108 begins at the location where middle section 110 abuts proximal side wall 108 and extends radially to the outer surface of handle 101. Distal side wall 109, on the other hand, is not beveled.

According to embodiments, the beveling of proximal side wall 108 allows a cleaning element installed in notch 107, such as any of cleaning elements 106*a*-106*f* in FIG. 1, to maximize surface contact with the inside of a bottle or container. For example, a user operates brush 100 by inserting distal end 103 of handle 101 into the opening of a bottle. When the circumference of the bottle is smaller than the circumference of the cleaning elements installed around distal end 103, the cleaning elements (being made of a flexible and resilient foam material) make contact with the side surfaces of the bottle and tend to flex in the opposite direct of movement of brush 100. That is, when brush 100 is moved downward inside of a bottle, the cleaning elements flex in the opposite direction of movement, which is toward proximal end 102 of handle 101.

In embodiments, the beveling of proximal side wall 108 allows the cleaning elements to flex further in the proximal direction, thereby increasing the bottle surface area that the cleaning elements come into contact with. On the other hand, when brush 100 is removed from a bottle or container, it moved in the proximal direction, which causes a flexure of the cleaning elements in the distal direction, that is, toward distal end 102. Since the distal side walls may not be beveled, the cleaning elements are held securely in place.

Figure 4:
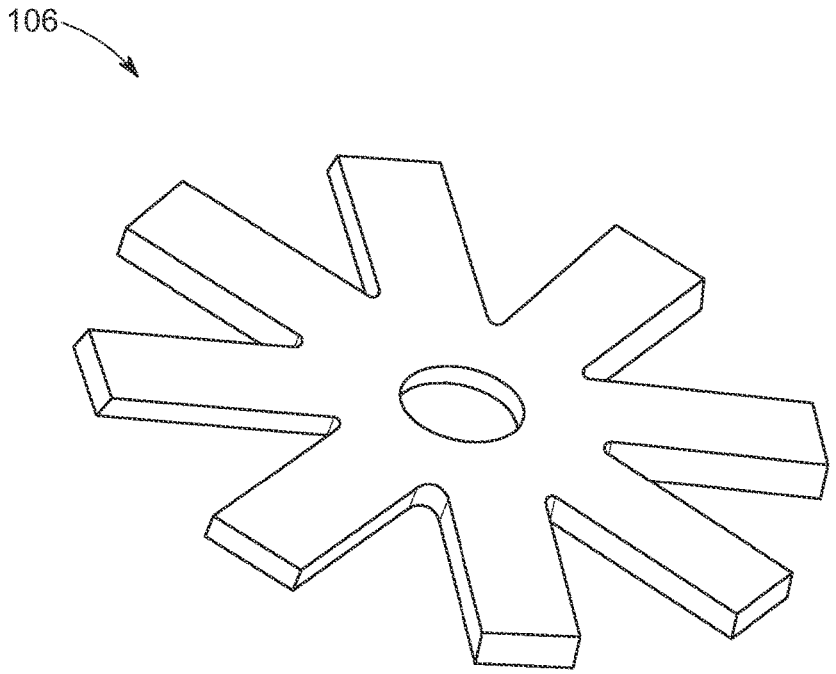
FIG. 4 illustrates a cleaning element adapted to engage a brush handle notch in accordance with exemplary embodiments of the present invention.

FIG. 4 depicts a perspective view of a cleaning element 106 in accordance with embodiments of the present invention. As described earlier, cleaning element 106 is comprised of a high-density foam material that does not damage surfaces that it comes into contact with during a cleaning operation. In embodiments, cleaning element 106 is comprised of a closed cell foam material that cleans while, at the same time, does not absorb liquids. In embodiments, the foam material of cleaning element 106 is dishwasher safe, that is, the material does not damage dishwasher components when being washed, nor is the material itself damaged during washing.

As shown, cleaning element 106 has a generally circular shape with an opening in the center. According to embodiments, a user can install cleaning element 106 into one of the notches 107 formed on handle 101 by inserting distal end 103 through the hole and then moving cleaning element 106 longitudinally along the length of distal end 103. Cleaning element 106 is comprised of a flexible and resilient foam material so that, as cleaning element 106 is moved along the length of distal end 103, the material expands as it comes into contact with portions of distal end 103 that have a diameter greater than the hole at the center of cleaning element 106.

As shown in FIG. 4, cleaning element 106 has a plurality of appendages, or "fingers," that extend radially from the circular center of the cleaning element. In embodiments, these fingers come into contact with the interior side surfaces of a bottle or container as brush 100 is inserted and moved into the bottle or container's interior. The fingers of cleaning element 106 are comprised of the same flexible and resilient foam material as the other parts of the cleaning element. Thus, when a finger makes contact with an interior surface of a bottle, the finger flexes in the opposite direction of the movement of the brush, and thereby increases the surface area that the finger makes contact with. The embodiment depicted in FIG. 4 has seven fingers. In other embodiments, more or fewer fingers can be provided.

As shown, cleaning element 106 has a thickness that is small enough to be accommodated by notches 107 on handle 101. Further, according to embodiments, the thickness of cleaning element 106 is large enough so that the cleaning element can be installed snugly within a notch 107, which prevents the cleaning element from sliding longitudinally within the middle section 110 of the notch while the brush is in use. According to embodiments, cleaning element 106 can have a thickness of 0.125 inches. A larger or smaller thickness is provided in other embodiments, whereby the thickness is driven by the width of middle section 110, which cleaning element 106 is installed around.

During use, when the brush is reciprocated, the cleaning action is enhanced by the flexure of the cleaning element 106 which presents different sides of the element to the surface of the bottle. Unlike a bristle brush, the surface of the cleaning element is smooth avoiding damage to softer bottles.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

What is claimed is:

1. A brush comprising:

an elongated shaft having a proximal end and a distal end oppositely disposed from the proximal end;

at least one cleaning element; and a tip fastened to the distal end of the elongated shaft, wherein the proximal end is shaped to be gripped by a hand of a user, wherein the distal end has a first diameter, wherein the distal end includes at least one notch formed therein, the notch comprising a proximal side wall, a distal side wall oppositely disposed from the proximal side wall, and a middle section disposed between the proximal side wall and the distal side wall, wherein the proximal side wall of each notch is beveled in the direction of the proximal end of the brush and the distal side wall of each notch is not beveled, wherein each middle section of the notch has a corresponding diameter that is less than the first diameter, wherein the at least one cleaning element has a center in which an opening is formed, and wherein the at least one cleaning element is disposed in a corresponding notch, whereby the middle section of the corresponding notch engages the opening of the corresponding cleaning element.

2. The brush of claim 1, wherein the beveling of the proximal side wall of each notch begins at a location where the middle section of the notch abuts the proximal side wall and extends radially to an outer surface of the distal end.

3. The brush of claim 1, wherein the tip is removably fastened.

4. The brush of claim 1 wherein the at least one cleaning element is formed of closed cell foam.

5. The brush of claim 4, wherein the closed cell foam is selected from the group consisting of an ethylene vinyl acetate polymer, a polyvinyl chloride polymer, and polyethylene.

6. The brush of claim 4, wherein the at least one cleaning element has a shape that is substantially circular, and wherein the at least one cleaning element includes a plurality of appendages extending radially from the center thereof.

7. The brush of claim 6, wherein the appendages, when moved in a first direction to engage an interior surface of a container, are adapted to flex in a direction opposite to the first direction.

8. The brush of claim 4, wherein the at least one cleaning element has a thickness of 0.125 inches.

9. The brush of claim 1, wherein the proximal end of the brush has a hole for hanging the brush formed therein.

10. The brush of claim 1, wherein the elongate shaft is comprised of a material selected from the group consisting of high-density polyethylene (HDPE), nylon, and polypropylene.

11. The brush of claim 1, wherein the distal end has a first length and the proximal end has a second length, wherein the first length is greater than the second length.

12. The brush of claim 1, wherein the elongate shaft has a length of 14 inches.

13. The brush of claim 1, wherein the distal end has a radius of at most 0.38 inches at an extreme distal point thereof.

14. The brush of claim 1, wherein the proximal end has an oval surface.

15. The brush of claim 1, wherein the proximal end is textured for enhancing the grip of the user.

16. The brush of claim 1, wherein the proximal end is coated with a slip-resistant material.

17. The brush of claim 16, wherein the slip-resistant material is selected from the group consisting of silicone and TPD.

18. A brush comprising:

an elongated shaft having a proximal end and a distal end oppositely disposed from the proximal end;

at least one cleaning element; and a tip fastened to the distal end of the elongated shaft, wherein the proximal end is shaped to be gripped by a hand of a user, wherein the distal end has a first diameter, wherein the distal end includes at least one notch formed therein, the notch comprising a proximal side wall, a distal side wall oppositely disposed from the proximal side wall, and a middle section disposed between the proximal side wall and the distal side wall, wherein each middle section of the notch has a corresponding diameter that is less than the first diameter, wherein the at least one cleaning element has a center in which an opening is formed, and wherein the at least one cleaning element is disposed in a corresponding notch, whereby the middle section of the corresponding notch engages the opening of the corresponding cleaning element, wherein the proximal side wall of each notch is beveled in the direction of the proximal end of the brush and the distal side wall of each notch is not beveled, wherein the beveling of the proximal side wall of each notch begins at a location where the middle section of the notch abuts the proximal side wall and extends radially to an outer surface of the distal end, wherein the at least one cleaning element is formed of closed cell foam, wherein the closed cell foam is selected from the group consisting of an ethylene vinyl acetate polymer, a polyvinyl chloride polymer, and polyethylene, wherein the at least one cleaning element has a shape that is substantially circular, wherein the at least one cleaning element includes a plurality of appendages extending radially from the center thereof, and wherein the appendages, when moved in a first direction to engage an interior surface of a container, are adapted to flex in a direction opposite to the first direction.

* * * * *